US011318529B2

(12) United States Patent
Araki et al.

(10) Patent No.: US 11,318,529 B2
(45) Date of Patent: May 3, 2022

(54) CASTING DEVICE

(71) Applicant: HONDA FOUNDRY CO., LTD., Kawagoe (JP)

(72) Inventors: Shintaro Araki, Kawagoe (JP); Makoto Sawai, Kawagoe (JP); Keisuke Ishii, Kawagoe (JP)

(73) Assignee: Honda Foundry Co., Ltd., Saitama (JP)

( * ) Notice: Subject to any disclaimer, the term of this patent is extended or adjusted under 35 U.S.C. 154(b) by 0 days.

(21) Appl. No.: 17/296,735

(22) PCT Filed: Mar. 25, 2019

(86) PCT No.: PCT/JP2019/012307
§ 371 (c)(1),
(2) Date: May 25, 2021

(87) PCT Pub. No.: WO2020/129271
PCT Pub. Date: Jun. 25, 2020

(65) Prior Publication Data

US 2021/0387251 A1 Dec. 16, 2021

(30) Foreign Application Priority Data

Dec. 20, 2018 (JP) ..... JP2018-237843

(51) Int. Cl.

| | |
|---|---|
| ***B22D 15/04*** | (2006.01) |
| ***B22C 9/06*** | (2006.01) |
| ***B22C 9/24*** | (2006.01) |
| ***B22D 18/04*** | (2006.01) |

(52) U.S. Cl.
CPC ..... *B22D 15/04* (2013.01); *B22C 9/061* (2013.01); *B22C 9/065* (2013.01); *B22C 9/24* (2013.01); *B22D 18/04* (2013.01)

(58) Field of Classification Search
CPC ..... B22D 15/00; B22D 15/02; B22D 15/04; B22D 18/04; B22C 9/061; B22C 9/065; B22C 9/24
See application file for complete search history.

(56) References Cited

U.S. PATENT DOCUMENTS 3,915,699 A 10/1975 Umehara et al.

FOREIGN PATENT DOCUMENTS

| | | | |
|---|---|---|---|
| JP | S50-13205 | B1 | 5/1975 |
| JP | H02-299740 | A | 12/1990 |
| JP | 3636108 | B2 | 4/2005 |
| JP | 2005-186125 | A | 7/2005 |
| JP | 2006-007270 | A | 1/2006 |
| JP | 2006-247732 | A | 9/2006 |
| JP | 2011-235337 | A | 11/2011 |
| JP | 6491735 | B1 | 3/2019 |

*Primary Examiner* — Kevin P Kerns
*Assistant Examiner* — Steven S Ha
(74) *Attorney, Agent, or Firm* — Carrier Blackman & Associates, P.C.

(57) ABSTRACT

A casting device includes a mold provided with an insert die, a molten metal supply device for supplying molten metal into the mold, and a gas supply mechanism for supplying a gas, which is used for forced cooling, to the insert die. The insert die is made of tungsten having a thermal conductivity significantly higher than that of die steel. The insert die has a spiral or meandering gas passage therein. The spiral or meandering gas passage has a passage length much longer than a straight passage.

8 Claims, 12 Drawing Sheets

COMPARATIVE EXAMPLE

MODIFIED EMBODIMENT OF THE INVENTION

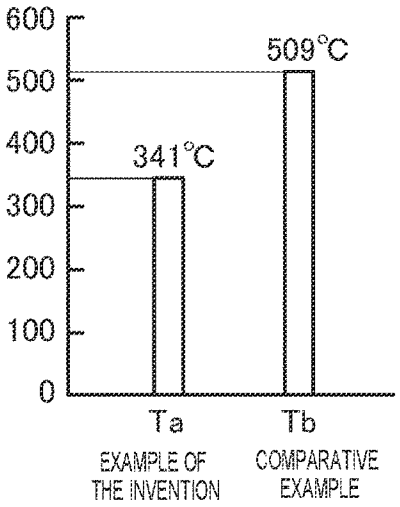
FIG.10C
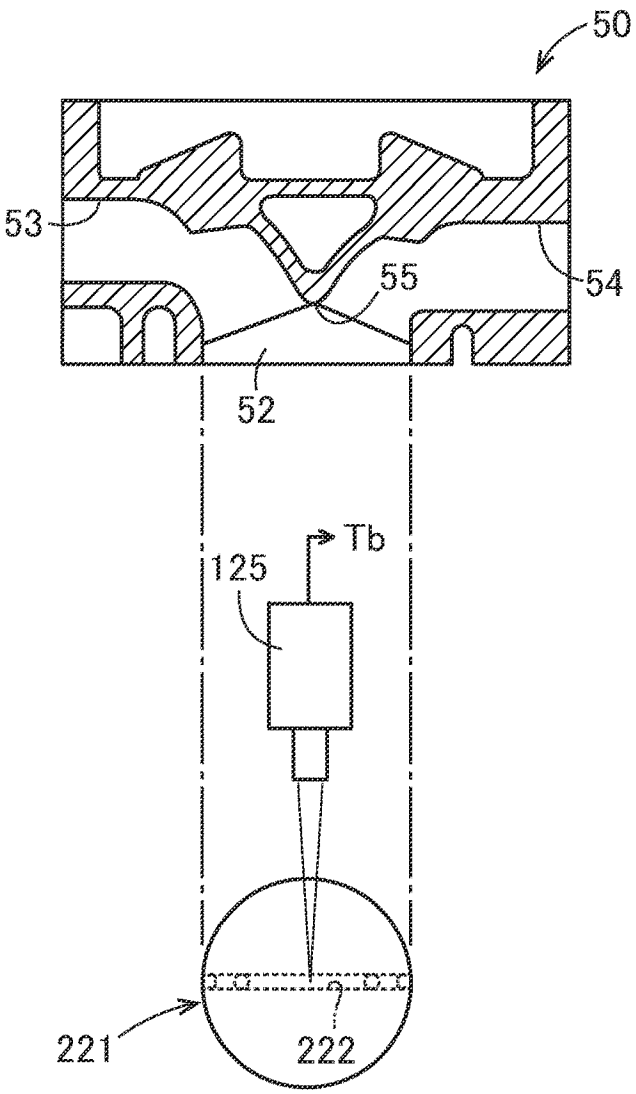
FIG.10B COMPARATIVE EXAMPLE
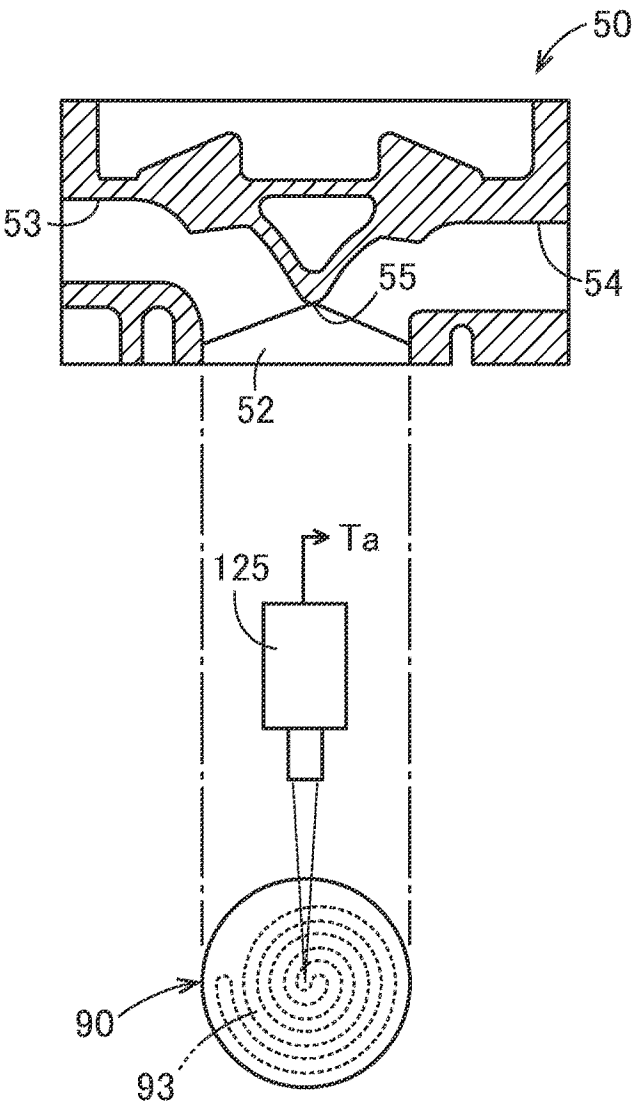
FIG.10A EXAMPLE OF THE INVENTION

COMPARATIVE
EXAMPLE

EXAMPLE OF
THE INVENTION

FIG.12A
PRIOR ART
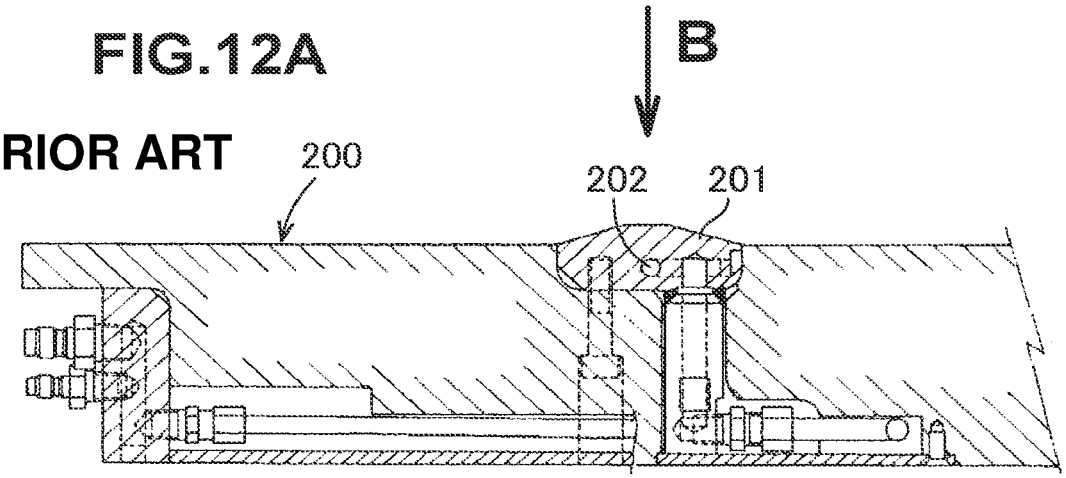
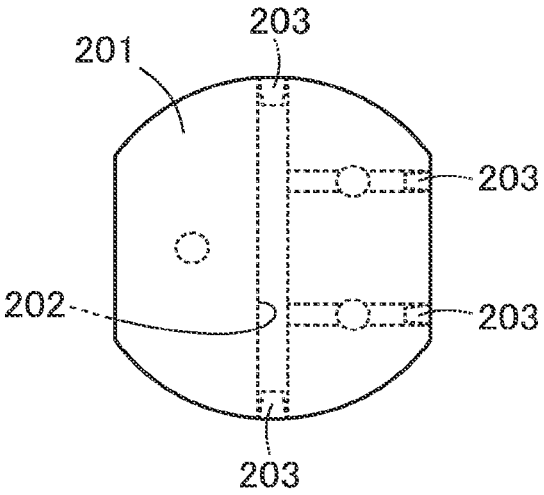
FIG.12B
PRIOR ART

CASTING DEVICE

TECHNICAL FIELD

The present invention relates to a casting device suitable for manufacturing a cylinder head, a piston and the like.

BACKGROUND ART

For example, one of the components of an internal combustion engine is a cylinder head. The cylinder head is manufactured by a casting method. In the casting method, a molten metal such as a molten aluminum alloy is injected into a cavity of a mold, and the metal is taken out from the mold when solidification of the molten metal is completed. The resulting product is the cylinder head.

The internal combustion engine has a combustion chamber. The shape of the combustion chamber greatly affects the output of the internal combustion engine. Therefore, the accuracy of the combustion chamber is required.

The cylinder head forms a part of the combustion chamber. Accuracy and strength are required for the portion where a part of the combustion chamber is formed in the cylinder head.

A technique for cooling a portion, which forms the combustion chamber in the die used to manufacture the cylinder head, is disclosed in, for example, Patent Literature Document 1.

Cooling can suppress the thermal deformation of the portion that forms the combustion chamber and the coarsening of a solidified structure. Without thermal deformation, the accuracy of the combustion chamber can be enhanced. Further, cooling can increase the density of the structure of the casting and enhance the strength.

A lower mold of the mold assembly used to manufacture a cylinder head according to Patent Literature Document 1 will be described with reference to FIGS. 12A-12B.

As shown in FIG. 12A, an insert die 201 is attached to a lower mold 200 of the mold assembly used to manufacture a cylinder head. The insert die 201 has a cooling passage 202 therein.

As shown in FIG. 12B, which is a view looked at in the direction of the arrow B in FIG. 12A, the coolant (cooling medium) passage 202 is made by a long drill. The cooling passage 202 is closed at both ends by plugs 203. Such a cooling passage 202 is referred to as a "straight flow passage".

As the water flows in the cooling passage 202, the temperature rise of the insert die 201 is prevented.

Similarly, a technique of casting a cylinder head using an insert die is disclosed in, for example, Patent Literature Document 2.

In a low-pressure casting method according to Patent Literature Document 2, the insert die is water-cooled from the start of pressing until the solidification of the combustion chamber portion is completed. After the solidification is completed, the insert die is air-cooled. As the insert die is cooled, the structure of the combustion chamber portion is densified.

The technique disclosed in Patent Literature Document 2 has problems that will be described below.

When air is switched to water in a cooling medium passage which is designed for water or air to flow, water containing air flows for a while. Because air has a low cooling capacity, it is necessary for the water to continue running until the water reaches 100%. Since a user should wait until it stabilizes, production efficiency decreases.

Further, it is known that when air is present between the water and the water in a pipe, the water is difficult to flow. This is because the air is a compressible fluid and the pressure of the water at the inlet side is not transmitted well to the water at the outlet side. Therefore, the pipe through which a liquid such as water flows is equipped with an air ventilation valve. Air is discharged to the outside by the air ventilation valve.

However, since the cooling passage 202 shown in FIG. 12A is situated at the uppermost position (highest position), it is difficult to cause the air to flow to the outside.

Therefore, the technique of Patent Literature Document 2, i.e., alternately causing water and air to flow in a single cooling medium passage is not recommended.

In addition, the techniques of Patent Literature Document 1 and Patent Literature Document 2 have a common problem that will be described below.

Components (such as calcium) contained in water change to an oxide thereof or a hydroxide thereof, and the resulting oxide or hydroxide adheres to the inner wall surface of the cooling passage 202 shown in FIG. 12A-12B. This deposit has a remarkably smaller thermal conductivity than metals such as iron. When the thermal conductivity is small, it becomes impossible to sufficiently cool the insert die 201 with water. As a result, the insert die 201 is melted and damaged.

Therefore, the casting technology which does not use water is required for the cooling of the insert die.

LISTING OF PRIOR ART REFERENCES

Patent Literature Documents

Patent Literature Document 1: Japanese Patent No. 3636108

Patent Literature Document 2: Japanese Patent Application, Laid-Open Publication No. 2011-235337

SUMMARY OF THE INVENTION

Problems to be Solved by the Invention

An object of the present invention is to provide a casting device equipped with an insert die to which water is not used.

Solution to the Problems

The invention according to claim 1 is directed to a casting device that includes a mold having an insert die, a molten metal supply device for supplying a molten metal to a cavity of the mold, and a gas supply mechanism for supplying a gas, which is used for forced cooling, to the insert die, wherein the insert die is a sintered product made from a powder whose main material contains at least one of tungsten, molybdenum and tungsten carbide, and the sintered product has a gas passage therein such that the gas which is used for forced cooling flows in the gas passage.

In the invention according to claim 2, it is preferred that the gas passage has one of a spiral shape and a meandering shape.

In the invention according to claim 3, it is preferred that a portion of the cross section of the gas passage is located near a surface of the insert die which contacts the molten metal.

In the inventions according to claims 4 and 5, it is preferred that the mold is used to cast a cylinder head of an internal combustion engine, and the insert die is used to form a combustion chamber.

Advantages of the Invention

In the invention according to claim 1, the insert die is made of tungsten, molybdenum or tungsten carbide, each of which has a significantly higher thermal conductivity than the die steel (steel from which the die is made). In addition, the gas passage is built in the insert die.

Thus, the present invention provides a low-pressure casting device equipped with an insert die that uses only gas and does not use water.

In the invention according to claim 2, the gas passage has the spiral shape or the meandering shape.

A conventional insert die is made of die steel and causes water to flow in a single straight passage. On the other hand, the insert die of the present invention is made from a material having a high thermal conductivity such as tungsten, the passage has the spiral or meandering shape, and the cooling medium is a gas. Therefore, the insert die of the present invention is not inferior to the conventional water-cooled insert die.

In the invention according to claim 3, a portion of the cross section of the gas passage is located in the vicinity of the surface of the insert die which contacts the molten metal.

Regarding the temperature of the insert die, the surface where the molten metal is in contact becomes the highest temperature. Since the gas passage extends to the vicinity of the surface of the insert die which is in contact with the molten metal, the insert die is effectively cooled.

In the inventions according to claims 4 and 5, the present invention is applied to a cylinder head of an internal combustion engine.

The present invention relates to a casting method with the air-cooled insert die, but can make a cylinder head with a combustion chamber having a dense structure.

BRIEF DESCRIPTION OF THE DRAWINGS

FIGS. 10A-10C is a set of views useful to describe an advantage of a spiral gas passage.

FIG. 12A is a cross-sectional view of a lower die of a conventional die assembly used to cast a cylinder head, and FIG. 12B a view when looked at in the direction of the arrow B in FIG. 12A.

DETAILED DESCRIPTION OF THE EMBODIMENTS

Hereinafter, a preferred embodiment of the present invention will be described with reference to the accompanying drawings.

Figure 1:
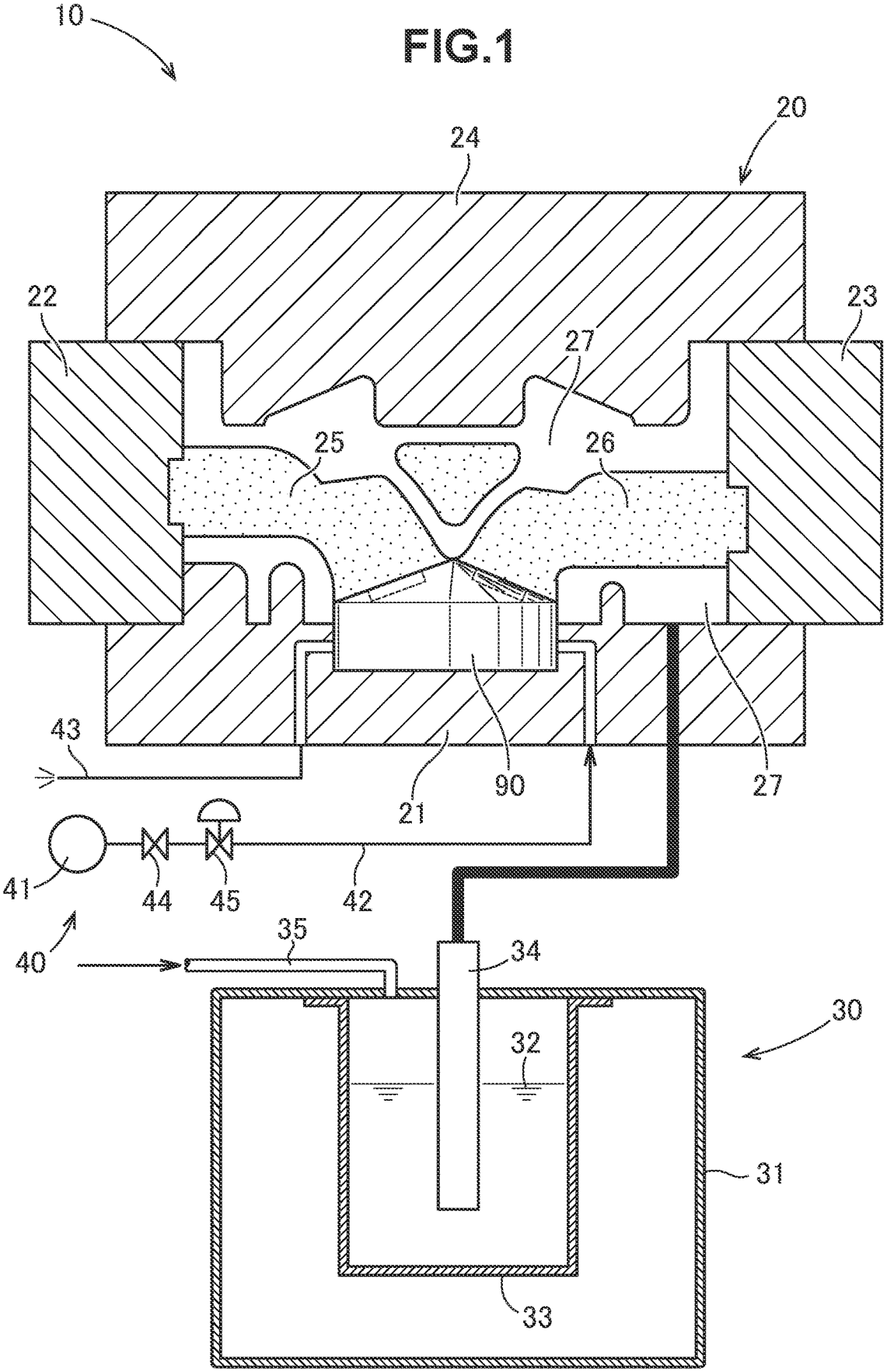
FIG. 1 is a view useful to describe a principle of a casting device according to an embodiment of the present invention.

As shown in FIG. 1, a casting device 10 includes a mold (mold assembly) 20 having an insert die 90, a molten metal supply device 30 for supplying a molten metal 32 to the mold 20, and a gas supply mechanism 40 for supplying a gas, which is used for forced cooling, to the insert die 90.

The gas supplied by the gas supply mechanism 40 may be any of air, nitrogen, carbon dioxide, or equivalent gas, and may be of any type.

The mold assembly 20 includes, for example, a lower mold 21, a left side mold 22 and a right side mold 23. The left side mold 22 and the right side mold 23 can slide to the left and the right. The mold assembly 20 also includes an upper mold 24 placed over the left side mold 22 and the right side mold 23, an insert die 90 placed at a center of an upper surface of the lower mold 21, a collapsible core 25 that spans the insert die 90 and the left side mold 22, and another collapsible core 26 that spans the insert die 90 and the right side mold 23.

The molten metal supply device 30 includes, for example, a furnace body 31 having a heater (or heaters) therein, a pot or pool 33 for storing the molten metal 32 surrounded by the furnace body 31, a stalk (conduit) 34 inserted into the molten metal 32 from above the molten metal, and a gas supply pipe 35 for sending compressed gas to the upper portion of the pot 33. Gas having a pressure of about "atmospheric pressure +50kPa" is sent from the gas supply pipe 35. Then, the molten metal 32 is pressed downward. This pressing down causes a part of the molten metal 32 to move upward in the stalk 34 and to be supplied to a cavity 27 in the mold 20.

Since the "atmospheric pressure +50kPa" is significantly lower than the die casting pressure, this casting method is also referred to as low pressurization casting or low-pressure casting. In this specification, the low-pressure casting is adopted.

The gas supply mechanism 40 includes, for example, a compressed gas source 41 such as a compressor or a compressed gas tank, a gas supply pipe 42 for supplying compressed gas from the compressed gas source 41 to the insert die 90, and a gas discharge pipe 43 for discharging the used gas to the outside from the insert die 90.

A stop valve 44 and a flow rate control valve 45 are provided on the gas supply line 42 such that gas having a desired flow speed or a desired flow rate is supplied to the insert die 90.

When the casting device 10 having the above-described configuration is used, the molten metal 32 is supplied to the cavity 27 from the molten metal supply device 30 while forcibly cooling the insert die 90 with a gas, in order to obtain a cast product (casting).

The cast product (casting) will be described with reference to the cylinder head 50 of an internal combustion engine. It should be noted, however, that the cast product is not limited to the cylinder head 50.

Figure 2:
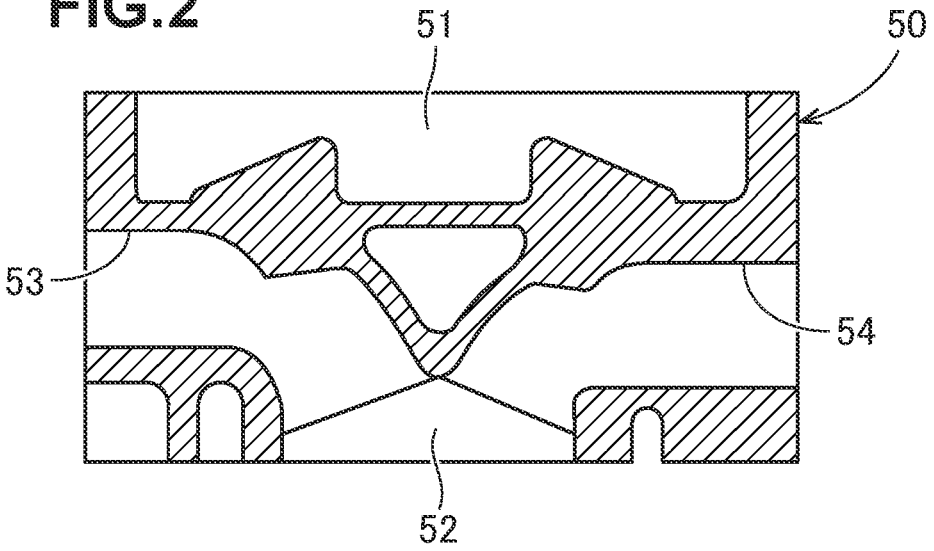
FIG. 2 is a cross-sectional view of a cylinder head.

As shown in FIG. 2, the cylinder head 50, which is the cast product, has a recess 51 for receiving a valve driving mechanism (FIG. 3, reference numeral 70) in an upper portion thereof, a combustion chamber 52 in a lower center thereof, an intake passage 53 on the left side and an exhaust passage 54 on the right side.

The combustion chamber 52 is formed by an insert die (FIG. 1, reference numeral 90).

A collapsible core (FIG. 1, reference numeral 25) is broken and scraped out when solidification of the molten metal is completed. The resulting hollow space or cavity becomes the intake passage 53.

Similarly, another collapsible core (FIG. 1, reference numeral 26) forms the exhaust passage 54.

An internal combustion engine 60 including the cylinder head 50 will be described with reference to FIG. 3.

Figure 3:
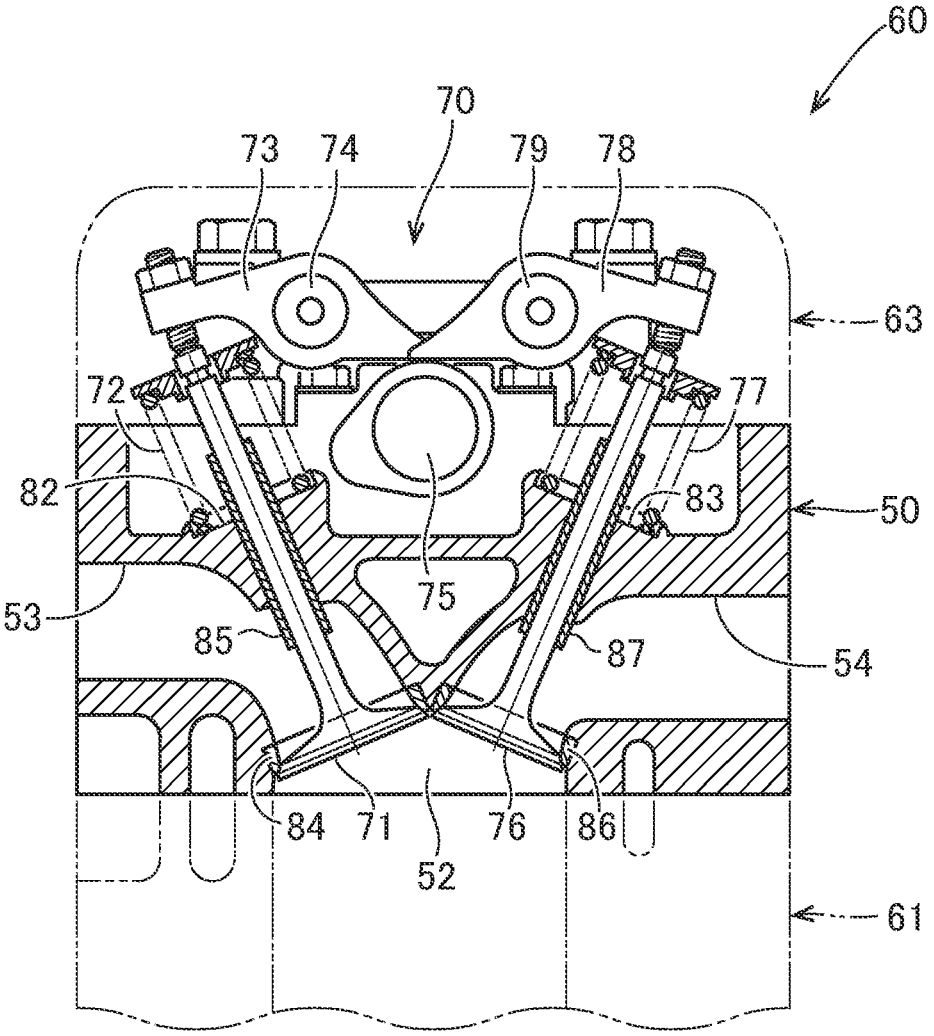
FIG. 3 is a cross-sectional view of an internal combustion engine.

As shown in FIG. 3, the internal combustion engine 60 has a cylinder block 61, the cylinder head 50 situated on the cylinder block 61, and a head cover 63 which covers the upper surface of the cylinder head 50.

The intake passage 53 and the exhaust passage 54 of the cylinder head 50 are opened and closed by the valve driving mechanism 70.

The valve driving mechanism 70 includes an intake valve 71 for opening and closing the intake passage 53, an intake-side spring 72 for biasing the intake valve 71 to the closing side (closed position), an intake-side rocker arm 73 for pushing the intake valve 71 to the open side (open position), an intake-side rocker arm shaft 74 for supporting the intake-side rocker arm 73, a camshaft 75 for swinging the intake-side rocker arm shaft 74, an exhaust valve 76 for opening and closing the exhaust passage 54, the exhaust-side spring 77 for biasing the exhaust valve 76 to the closing side, an exhaust-side rocker arm 78 for pushing the exhaust valve 76 to the open side, and an exhaust-side rocker arm 79 for supporting the exhaust-side rocker arm 78. The exhaust-side rocker arm 78 is also caused to swing by the camshaft 75.

Below the intake valve 71 and exhaust valve 76, defined is the combustion chamber (more specifically, the top of the combustion chamber) 52.

An intake-side spring seat 82 and an exhaust-side spring seat 83 are prepared by machining the cast product.

After the cast product undergoes the machining, an intake-side valve seat 84, an intake-side valve guide 85 disposed above the intake-side valve seat 84, an exhaust-side valve seat 86 and an exhaust-side valve guide 87 disposed above the exhaust-side valve seat 86 are fitted in the cast product.

Because the combustion chamber 52 is exposed to a high-temperature combustion gas, the combustion chamber 52 is required to have greater high-temperature strength than other parts and portions. By cooling the combustion chamber with the insert die 90, the metal structure of the combustion chamber 52 becomes dense. As the metal structure of the combustion chamber 52 becomes dense, the strength of the combustion chamber 52 is enhanced.

Figure 4:
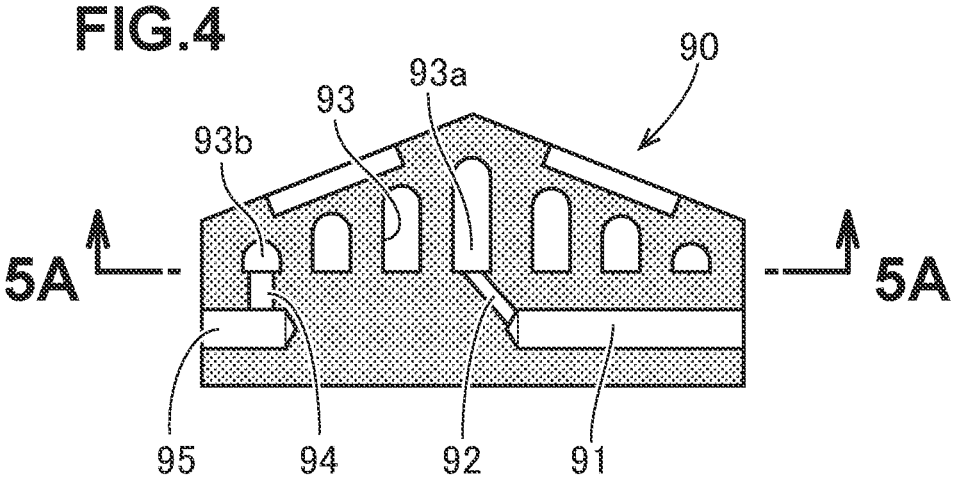
FIG. 4 is a cross-sectional view of an insert die.

As shown in FIG. 4, the insert die 90 includes a first horizontal hole 91, a first vertical hole 92 extending obliquely from the first horizontal hole 91, an inlet 93*a* formed at an end of the first vertical hole 92, a gas passage 93 extending from the inlet 93*a*, an outlet 93*b* of the gas passage 93, a second vertical hole 94 extending downward from the outlet 93*b*, and a second horizontal hole 95 extending from the second vertical hole 94.

The gas passage 93 has a vertically elongated rectangular or oval cross-section and an upper end of the gas passage 93 reaches the vicinity of the top surface of the insert die 90. The top surface of the insert die 90 is a surface in contact with the molten metal. Because the cooling medium flows in the gas passage 93 that reaches the vicinity of the top surface of the insert die 90, the upper surface of the insert die 90, which becomes the highest temperature in the insert die 90, is effectively cooled.

That is, a portion of the cross section of the gas passage 93 is situated near the surface of the insert die 90 which contacts the molten metal (in this embodiment, the top surface of the insert die). The surface of the insert die 90 which contacts the molten metal becomes the highest temperature. Since the gas passage 93 extends to the vicinity of the surface of the insert die 90 which is in contact with the molten metal, the insert die 90 is effectively cooled.

Figure 5A:
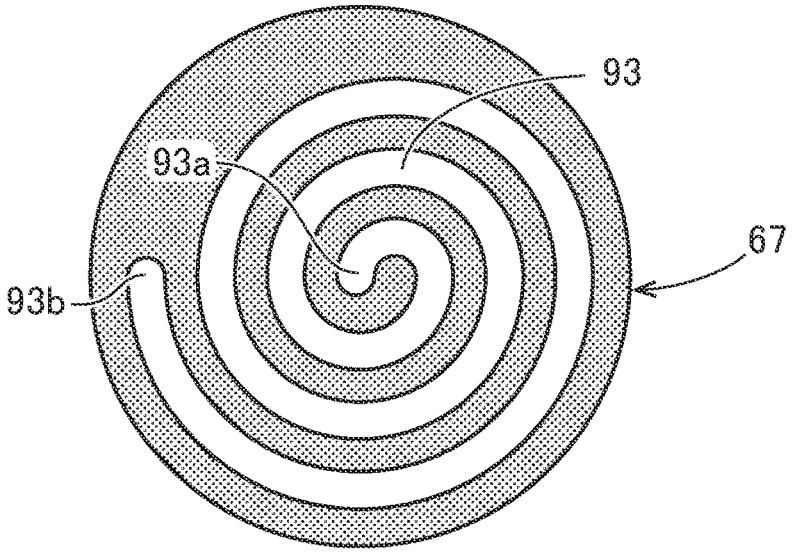
FIG. 5A is a cross-sectional view of FIG. 4, taken along the line 5A-5A.

FIG. 5A is a cross-sectional view taken along the line 5A-5A in FIG. 4. The gas passage 93 has a spiral shape.

Figure 5B:
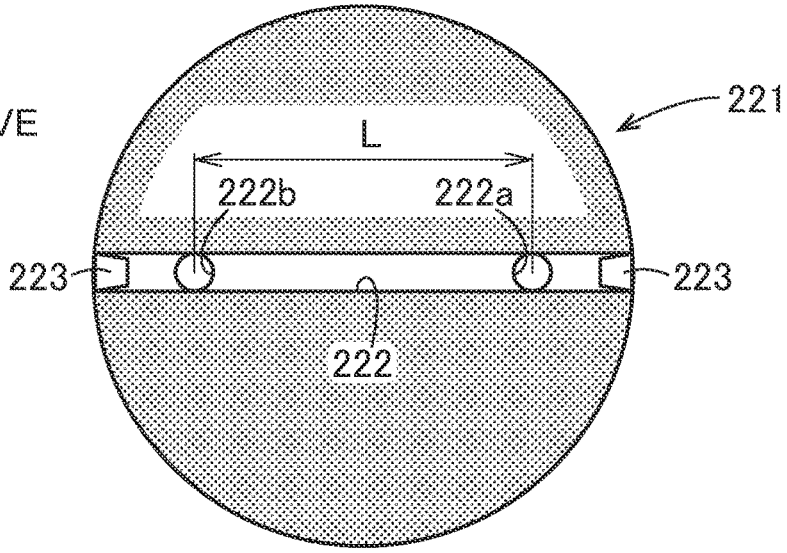
FIG. 5B is a view useful to describe a comparative example.

A comparative example is shown in FIG. 5B. In this comparative example, an insert die 221 has a straight passage 222 drilled with a long drill. The straight passage 222 is closed at both ends by plugs 223.

Figure 5C:
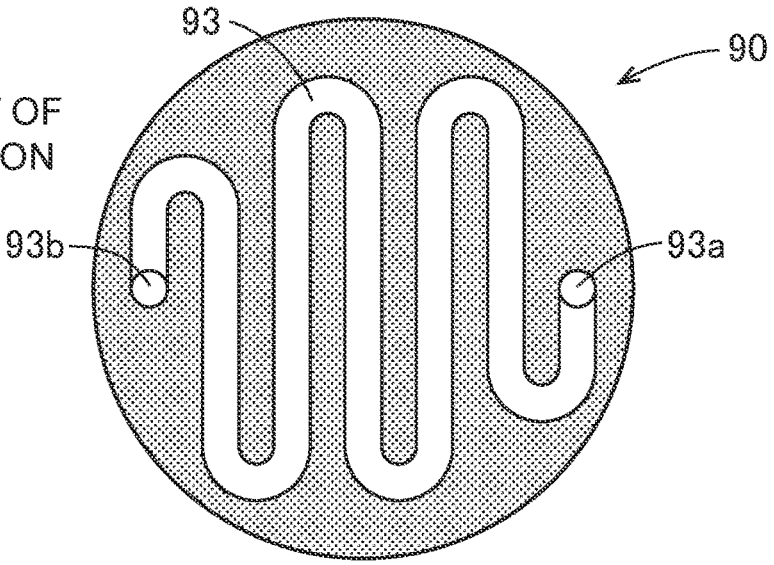
FIG. 5C is a view useful to describe a modified embodiment.

Further, a modified embodiment of the present invention is shown in FIG. 5C. In this modified embodiment, the gas passage 93 has a meandering (winding) shape.

In the straight passage 222 shown in FIG. 5B, the distance between an inlet 222*a* and an outlet 222*b* is denoted by L. The space between the inlet 222*a* and the plug 223 serves as a pool for the cooling medium and hardly contributes to cooling. The same applies between the outlet 222*b* and the plug 223. Therefore, the distance L is the length that contributes to cooling.

Regarding the gas passage 93 shown in FIG. 5A, the distance between the inlet 93*a* and the outlet 93*b* is approximately 7×L.

Regarding the gas passage 93 shown in FIG. 5C, the distance between the inlet 93*a* and the outlet 93*b* is approximately 6×L.

The gas passage 93, which has the spiral shape or the meandering shape, is six to seven times longer than the conventional straight passage 222.

However, it is not easy to prepare the gas passage 93 that has the spiral shape or the meandering shape. Therefore, a method of forming the gas passage 93 exhibiting the spiral shape will be described with reference to FIG. 6A to FIG. 9C.

Figure 6A:
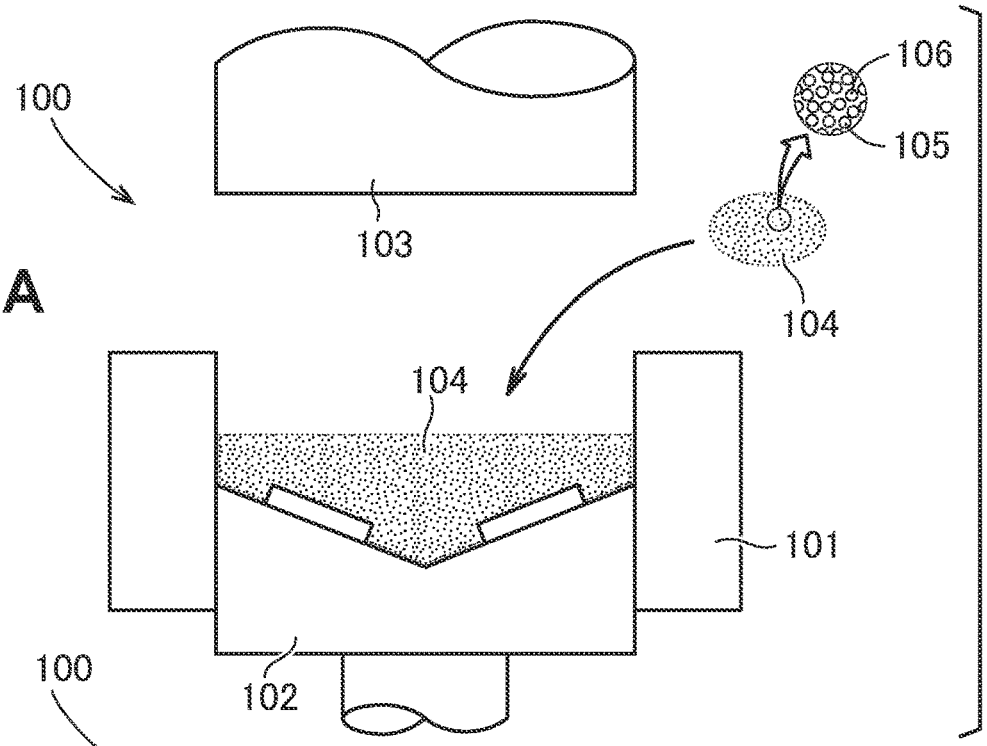
FIGS. 6A-6D is a set of views useful to describe a method of manufacturing an insert die.

As illustrated in FIG. 6A, a first mold 100 is prepared. The first mold 100 includes a first die 101, a first lower punch 102 that fits in the first die 101 from below the first die, and a first upper punch 103 disposed above the first lower punch 102. Then, a metal mixed powder 104, which is a powder whose main material is tungsten, is loaded into the first die 101.

Preferably, the metal mixed powder 104 is a mixture of a tungsten powder 105, which is the main material, and a nickel powder 106, which is an auxiliary material. It should be noted that other than the tungsten powder, the main material of the metal mixed power may be a molybdenum powder or a tungsten carbide powder, or may be a mixture thereof.

As the mixing ratio, it is sufficient that the main material is 80 to 99% by mass and the remainder is the auxiliary material.

Figure 6B:
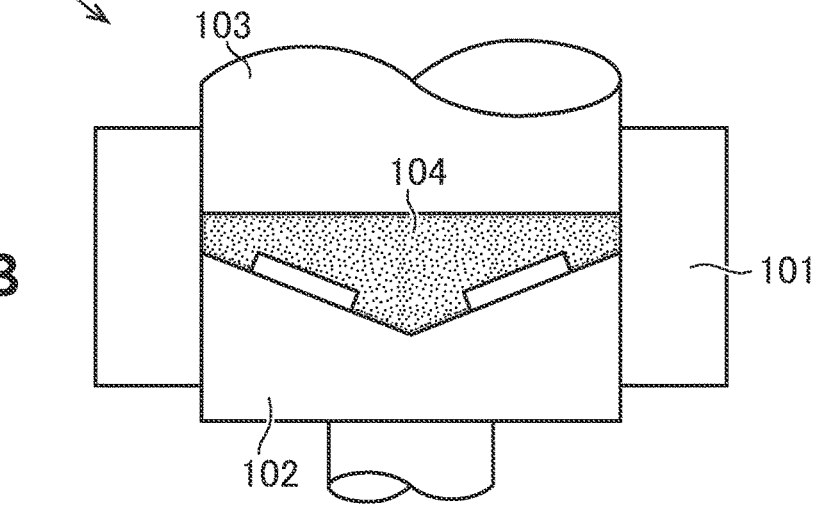

In FIG. 6B, the metal mixed powder 104 in the first die 101 is compressed by the first lower punch 102 and the first upper punch 103.

Figure 6C:
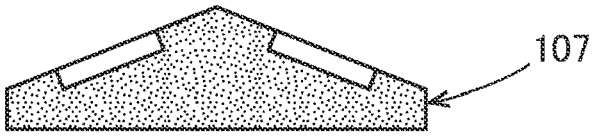

Thus, a first green compact 107 shown in FIG. 6C is obtained. Next, as shown in FIG. 6D, groove-shaped gas passages 93 which are open downward are formed in the first green compact 107 by machining.

Incidentally, in order to create the first green compact 107 and the gas passages 93 at the same time, a convex portion may be provided on the first upper punch 103. The convex portion corresponds to the groove-shaped gas passages.

Figure 7A:
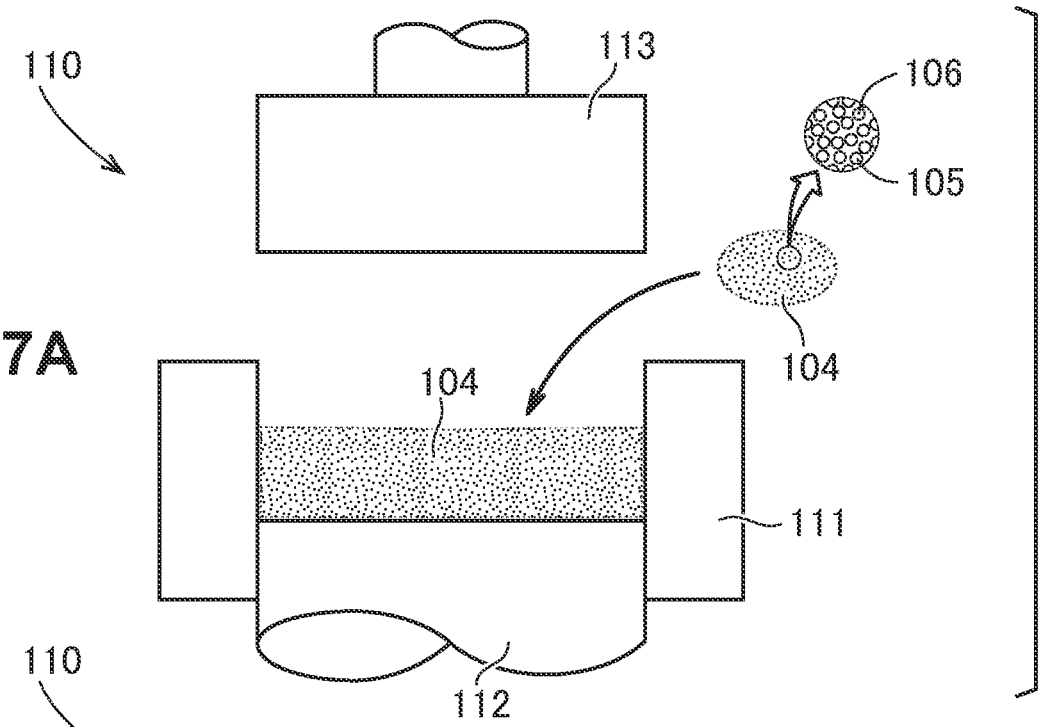
FIGS. 7A-7D is another set of views useful to describe the method of manufacturing the insert die.

As shown in FIG. 7A, a second mold 110 is prepared. The second mold 110 includes a second die 111, a second lower punch 112 that fits in the second die 111 from below the second die, and a second upper punch 113 disposed above the second lower punch 112. Then, the metal mixed powder 104 is loaded into the second die 111.

Figure 6D:
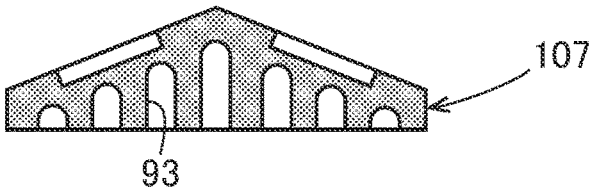

The metal mixed powder 104 is the same material as the components of the first green compact (FIGS. 6C-6D, reference numeral 107).

Figure 7B:
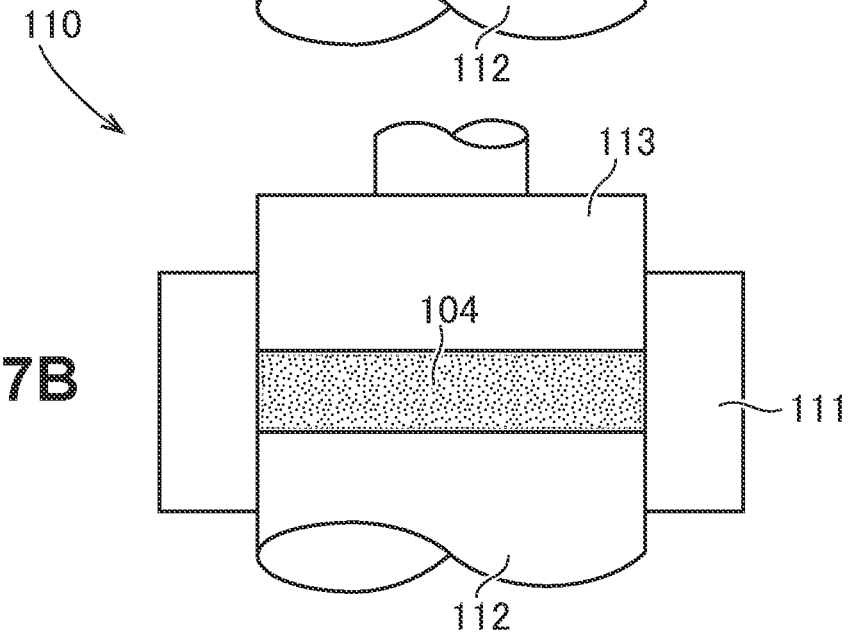

In FIG. 7B, the metal mixed powder 104 in the second die 111 is compressed by the second lower punch 112 and the second upper punch 113.

Figure 7C:
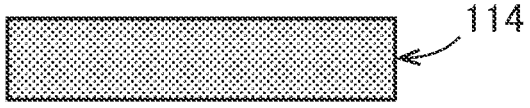

Thus, a second green compact 114 shown in FIG. 7C is obtained.

Figure 7D:
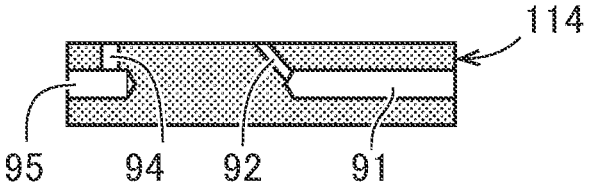

As shown in FIG. 7D, a first long horizontal hole 91, a first vertical hole 92 extending upward from the distal end of the first horizontal hole 91, a second short horizontal hole 95 provided on the opposite side of the first horizontal hole 91, and a second vertical hole 94 extending upward from the distal end of the second horizontal hole 95 are formed in the second green compact 114 by machining.

Figure 8A:
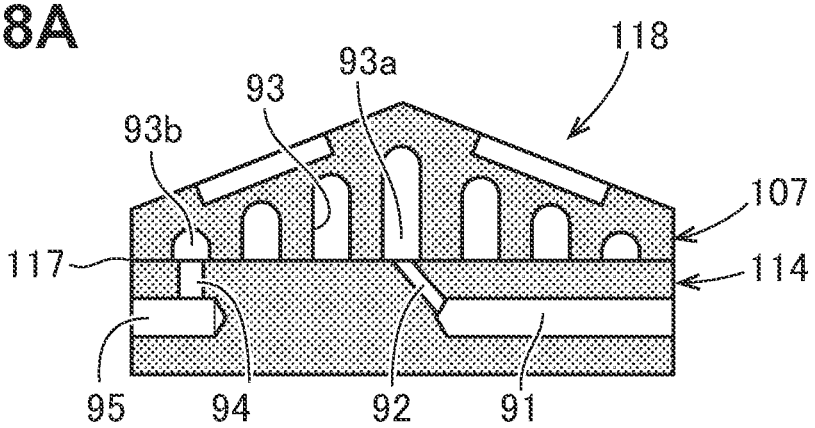
FIGS. 8A-8B is still another set of views useful to describe the method of manufacturing the insert die.

Next, as shown in FIG. 8A, the first green compact 107 is placed on the second green compact 114. The interface between the first green compact 107 and the second green compact 114 is a boundary 117.

In the resulting laminate 118, the first vertical hole 92 is connected to the inlet 93*a* of the gas passage 93, and the second vertical hole 94 is connected to the outlet 93*b* of the gas passage 93.

Figure 8B:
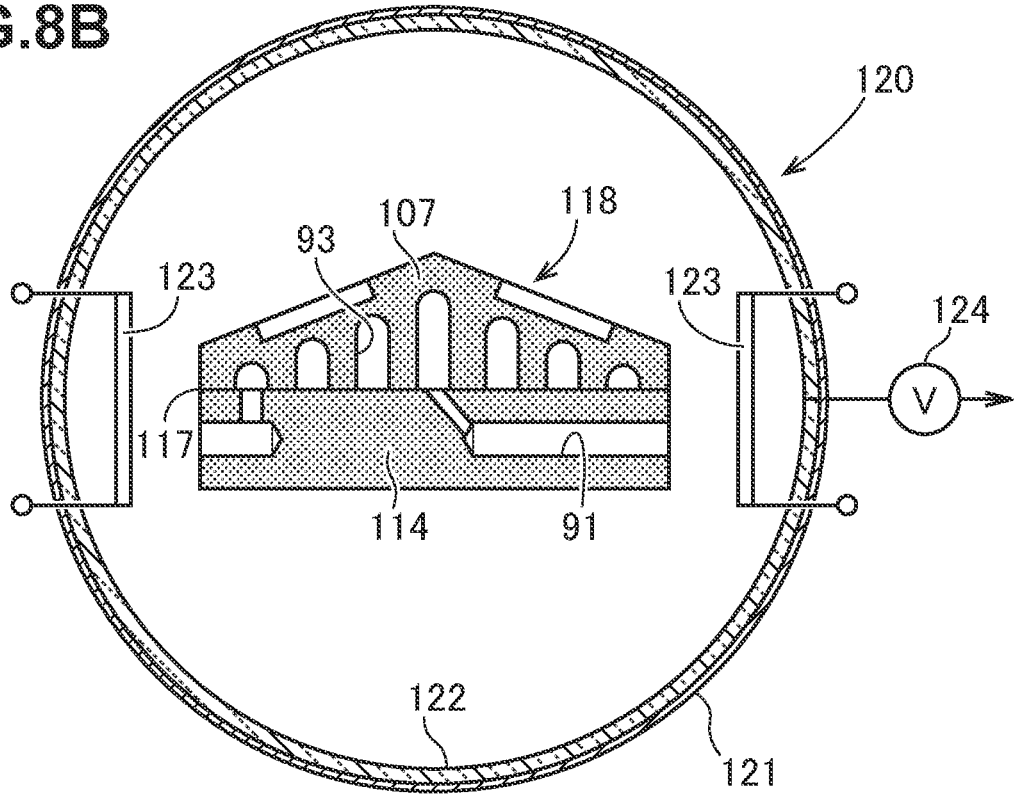

Next, as shown in FIG. 8B, the laminate 118 is placed in a sintering furnace 120 such that the laminate undergoes a liquid-phase sintering process.

The sintering furnace 120 includes, for example, a cylindrical container 121, a heat insulator 122 which is lined in the container 121, heaters 123 disposed in the container 121, and a vacuum pump 124 for evacuating the container 121.

When the interior of the container 121 is evacuated by the vacuum pump 124, the atmospheric pressure is applied to the outer peripheral surface of the container 121. Since the container 121 is cylindrical, there is no fear of collapse. Carbon burns in the atmosphere, but does not burn in vacuum. Thus, carbon fibers may be used as the material of the insulating member 122 and carbon rods may be used for the heaters 123. The carbon rods glow upon supplying electricity only, and serve as the heaters.

Incidentally, the liquid-phase sintering process may be carried out in an inert gas (argon gas, nitrogen gas) atmosphere if it is not carried in the vacuum. Therefore, the sintering furnace 120 is not limited to a vacuum sintering facility.

The liquid-phase sintering method is a processing method in which some components are dissolved during sintering and the sintering proceeds in the state of liquid phase mixture. Returning to the embodiment, the subsequent processes in the method of making the gas passage will be described.

The melting point of tungsten is 3380 degrees C. and the melting point of nickel is 1453 degrees C. After the interior of the container 121 is brought into a vacuum state, the interior of the container is kept at about 1500 degrees C. by the heaters 123.

Then, the nickel powder, which has a lower melting point than tungsten, is liquefied and the tungsten powder, which has a higher melting point than nickel, remains in the solid phase. Accordingly, the liquid-phase sintering proceeds in the state of the liquid phase mixture.

Figure 9A:
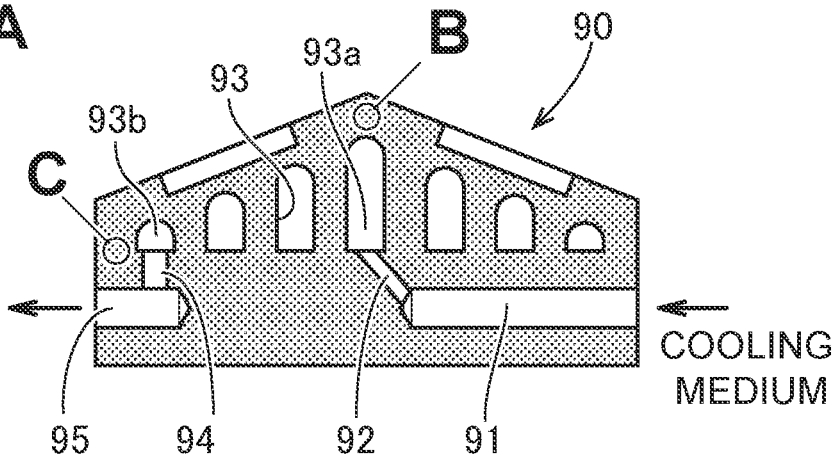
FIGS. 9A-9C is a set of views useful to describe a metal structure of the insert die.

Thus, the insert die 90 is obtained as a sintered product shown in FIG. 9A. In this insert die 90, when the gas is fed into the first transverse hole 91, the gas enters the gas passage 93 through the first vertical hole 92 such that the gas cools the insert die 90 entirely (in every nook and corner) while passing through the gas passage 93. The warmed gas is discharged to the outside through the outlet 93*b*, the second vertical hole 94, and the second horizontal hole 95.

Figure 9B:
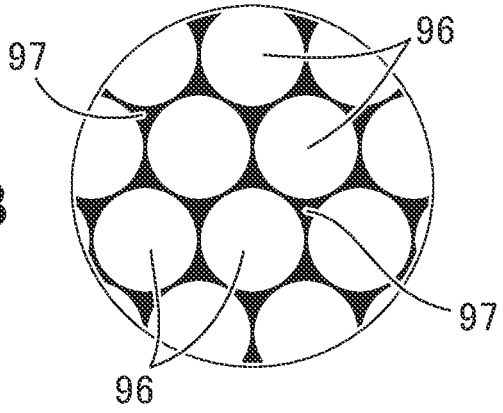

FIG. 9B is an enlarged view of the portion B in FIG. 9A. FIG. 9B shows a cross-sectional view of the general portion of the insert die 90. Tungsten particles 96 are sintered with gaps being filled with molten nickel 97.

Figure 9C:
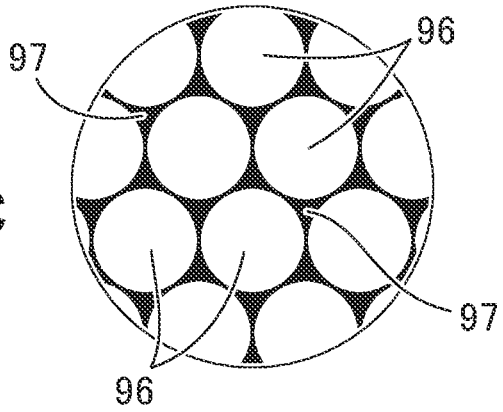

FIG. 9C is an enlarged view of the portion C in FIG. 9A. FIG. 9C illustrates an area near the interface between the outlet 93*b* and the second vertical hole 94, i.e., the boundary (FIGS. 8A-8B, reference numeral 117). Similar to FIG. 9B, the tungsten particles 96 are sintered with the gaps being filled with the molten nickel 97.

Suppose that one sintered product is made by a sintering process, and another sintered product is made by the sintering process. Then, the above-mentioned one sintered product and the above-mentioned another sintered product are superimposed, and undergo the sintering process again to connect (join) them to each other. Then, an unavoidably boundary layer is created on the boundary between the above-mentioned one sintered product and the above-mentioned another sintered product. The boundary layer generated upon carrying out the sintering process twice is undesirable because the boundary layer becomes a factor of reducing the strength.

In the embodiment of the invention, on the other hand, the sintering process is carried out only once, and therefore the boundary layer is not formed. That is, the boundary 117 between the first green compact 107 and the second green compact 114 shown in FIG. 8A disappeared. In addition, the connecting portion between the first green compact 107 and the second green compact 114 is liquid-phase sintered in the same manner as the general portion of the product. No detrimental boundary layer is generated at the connection portion.

Thus, as described in connection with FIG. 9A to FIG. 9C, there is no boundary layer itself in the insert die 90 according to the embodiment of the invention. As a result, the mechanical strength becomes sufficiently high. The boundary layer becomes an obstacle against thermal conduction. The insert die 90 according to the embodiment of the present invention maintains high thermal conductivity because the boundary layer itself is not present.

The superiority of the above-described insert die 90 was confirmed by experiments. The experiments and results will be described below.

Experiment 1:

Experimental Purpose: To confirm the superiority of a spiral-shaped gas passage to a straight passage.

Experimental facility: Low-pressure casting device shown in FIG. 1

Insert die of an example of the invention:

Sintered tungsten product

Spiral-shaped gas passage

Insert die of a comparative example:

Sintered tungsten product

Straight passage

Cooling medium: air in the example of the invention and also in the comparative example Molten metal: aluminum alloy (AC2B)

As shown in FIG. 10A, the cast product (cylinder head 50) was removed from a mold equipped with the insert die 90 having the spiral-shaped gas passage 93. Immediately thereafter, the center of the insert die 90 (the portion corresponding to a plug seat 55) was measured by an infrared thermometer (or radiation thermometer) 125 to obtain temperature Ta.

Also, as shown in FIG. 10B, the cast product 50 was removed from a mold equipped with an insert die 221 having a straight passage 222. Immediately thereafter, the center of the insert die 221 was measured by the infrared thermometer 125 to obtain temperature Tb.

As shown in FIG. 10C Ta (example of the invention) was 341 degrees C. On the other hand, Tb (comparative example) was 509 degrees C.

By changing the straight passage to the spiral-shaped gas passage, the temperature of the insert die 90 was significantly lowered.

In example of the invention and the comparative examples, the material of the insert die is both tungsten, and the refrigerant (cooling medium) is both a gas. When the example of the invention is compared to the comparative examples, only the length of the cooling medium passage or the gas passage differs. Due to the difference in the passage length, the example of the invention has experienced a significant temperature drop.

Experiment 2:

Experimental purpose: To confirm that a DASII value is reduced.

DASII is an abbreviation for Dendrite Arm Spacing II. The DASII value is obtained by observing and measuring the cut surface of the sample with a microscope. The DASII value indicates the size of the solidified structure and is one of the values to judge the denseness of the structure.

Experimental facility: Low-pressure casting device shown in FIG. 1

Insert die of the example of the invention:

Sintered tungsten product

Spiral-shaped passage

Cooling medium: Gas (air)

Insert die of the comparative example:

Sintered tungsten product

Straight passage

Cooling medium: None

Molten metal: aluminum alloy (AC2B)

Figure 11C:
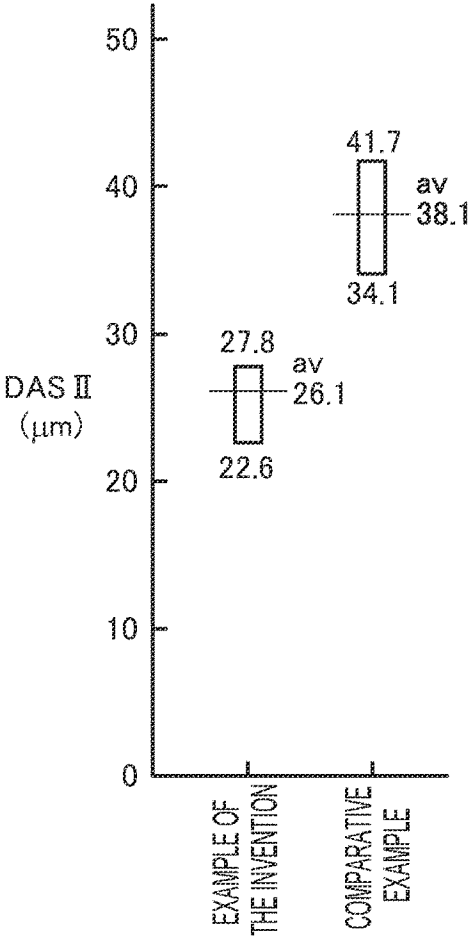
FIGS. 11A-11C is a set of views useful to describe DASII measurement results.
Figure 11B:
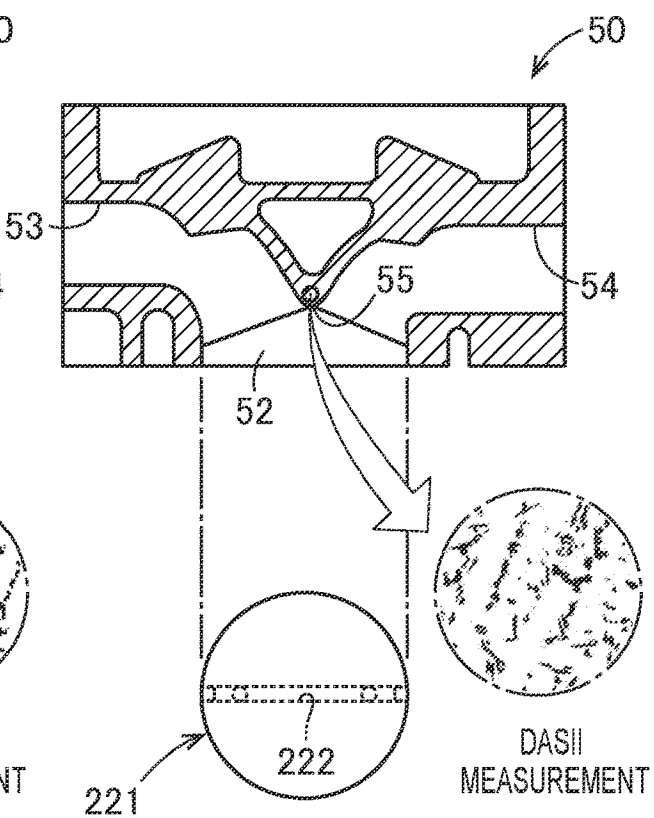
Figure 11A:
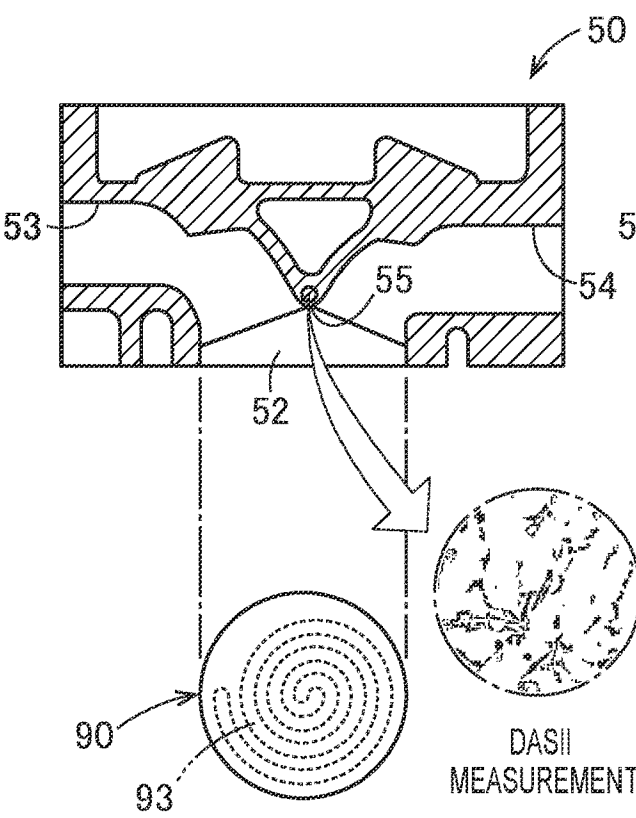

As shown in FIG. 11A, the cast product was removed from a mold equipped with the insert die 90 having the spiral-shaped gas passage 93. A sample was taken from an area near the plug seat 55 of the resulting cast product, and the sample was magnified by a microscope such that DASII values were measured at a plurality of locations of the sample.

As shown in FIG. 11B, the insert die 221 has the straight passage 222 but is substantially non-cooled. The casting product was removed from the mold equipped with the insert die 221. A sample was taken from an area near the plug seat 55 of the resulting cast product, and the sample was magnified by a microscope such that DASII values were measured at a plurality of locations of the sample.

As shown in FIG. 11C, in the example of the invention, a minimum DASII value was 22.6 μm, a maximum DASII value was 27.8 μm, and an average DASII value was 26.1 μm.

In contrast, in the comparative example, a minimum DASII value was 34.1 μm, a maximum DASII value was 41.7 μm, and an average DASII value was 38.1 μm.

The DASII values of the combustion chamber are required to be equal to or smaller than 35 μm, and preferably equal to or smaller than 30 μm. The maximum DASII value of the example of the invention is 27.8 μm, which sufficiently satisfies the requirement.

It should be noted that in general an insert die is made from a cast steel or die steel. Thermal conductivity of the cast steel or die steel is about 50 W (m·K).

On the other hand, the thermal conductivity of the tungsten employed in the embodiment of the present invention is 177 W/(m·K). Because the thermal conductivity of tungsten is about 3.5 times larger, the cooling efficiency is improved. Because the insert die is made of tungsten, a small amount of gas can cool the insert die 90 sufficiently and entirely.

Carbon steel (Fe) has a melting point of 1540 degrees C. and a thermal conductivity of about 50 W/(m·K).

In contrast, tungsten has a melting point of 3400 degrees C. and a thermal conductivity of 177 W/(m·K).

Molybdenum has a melting point of 2620 degrees C. and a thermal conductivity of 139 W/(m·K).

Tungsten carbide has a melting point of 2870 degrees C. and a thermal conductivity of 84 W/(m·K).

The inventors of the present invention made a molybdenum sintered product and a tungsten carbide sintered product, and confirmed that both of the molybdenum sintered product and the tungsten carbide sintered product had higher thermal conductivity than steel and were strong against melting-erosion.

Therefore, a molybdenum sintered product may be obtained by changing the tungsten powder to the molybdenum powder or a tungsten carbide sintered product may be obtained by changing the tungsten powder to the tungsten carbide powder.

The cast product obtained by the casting device 10 of the embodiment of the present invention may be, in addition to the cylinder head 50, a piston core or a piston top core, i.e., the cast product obtained by the casting device 10 of the embodiment of the present invention is not limited to the cylinder head 50.

Although the casting device 10 of the embodiment of the present invention is a low-pressure casting device, the casting device may be a gravitational force casting device, a high-pressure casting device, or a sand-mold casting device, i.e., the casting device is not limited to the low-pressure casting device.

The gas passage 93 has the spiral shape or the meandering (winding) shape in the above-described embodiment, but the shape of the gas passage 93 is not limited to the spiral shape or the meandering (winding) shape as long as the gas passage has a shape that provides a longer cooling length than the straight shape, e.g., the gas passage may be U-shaped, circular, planar, fin-shaped, or the like.

INDUSTRIAL APPLICABILITY

The present invention is suitable for a casting device used to cast a cylinder head, a piston or the like.

REFERENCE NUMERAL AND SUMBOLS

10 . . . Casting device, 20 . . . mold assembly, 27 . . . cavity, 30 . . . molten metal supply device, 32 . . . molten metal, 40 . . . gas supply mechanism, 50 . . . cylinder head, 52 . . . combustion chamber, 60 . . . internal combustion engine, 90 . . . insert die, 93 . . . gas passage, 105 . . . tungsten powder.

The invention claimed is:

1. A casting device that includes a mold having an insert die, a molten metal supply device for supplying a molten metal to a cavity of the mold, and a gas supply mechanism for supplying a gas, which is used for forced cooling, to the insert die, the insert die being a sintered product made from a powder whose main material contains at least one of tungsten, molybdenum and tungsten carbide, and the sintered product having a gas passage therein such that the gas which is used for forced cooling flows in the gas passage.

2. The casting device of claim 1, wherein the gas passage has one of a spiral shape and a meandering shape.

3. The casting device according to claim 2, wherein a portion of a cross section of the gas passage is located near a surface of the insert die which contacts the molten metal.

4. The casting device of claim 3, wherein the mold is used to cast a cylinder head of an internal combustion engine, and the insert die is used to form a combustion chamber.

5. The casting device according to claim 2, wherein the mold is used to cast a cylinder head of an internal combustion engine, and the insert die is used to form a combustion chamber.

6. The casting device according to claim 1, wherein a portion of a cross section of the gas passage is located near a surface of the insert die which contacts the molten metal.

7. The casting device of claim 6, wherein the mold is used to cast a cylinder head of an internal combustion engine, and the insert die is used to form a combustion chamber.

8. The casting device according to claim 1, wherein the mold is used to cast a cylinder head of an internal combustion engine, and the insert die is used to form a combustion chamber.

* * * * *